US008298922B2

(12) United States Patent
Schumann et al.

(10) Patent No.: US 8,298,922 B2
(45) Date of Patent: Oct. 30, 2012

(54) ELECTRICAL PLUG CONNECTOR

(75) Inventors: Andreas Schumann, Steinenbronn (DE); Hartmut Gaertner, Stuttgart (DE)

(73) Assignee: Telegaertner Karl Gaertner GmbH, Steinenbronn (DE)

( * ) Notice: Subject to any disclaimer, the term of this patent is extended or adjusted under 35 U.S.C. 154(b) by 0 days.

(21) Appl. No.: 13/151,421

(22) Filed: Jun. 2, 2011

(65) Prior Publication Data

US 2011/0300740 A1 Dec. 8, 2011

Related U.S. Application Data

(63) Continuation of application No. PCT/EP2009/061503, filed on Sep. 4, 2009.

(30) Foreign Application Priority Data

Dec. 19, 2008 (DE) ..... 10 2008 064 535

(51) Int. Cl.
*H01R 24/00* (2006.01)

(52) U.S. Cl. ..... 438/467

(58) Field of Classification Search ..... 439/465, 439/467

See application file for complete search history.

(56) References Cited

U.S. PATENT DOCUMENTS 4,005,922 A * 2/1977 Burkhart et al. ..... 439/465
4,023,879 A * 5/1977 Braund et al. ..... 439/76.1
4,553,111 A 11/1985 Barrow
4,560,962 A 12/1985 Barrow
4,653,836 A * 3/1987 Peele ..... 439/607.47
4,935,093 A 6/1990 Reeb
4,990,094 A 2/1991 Chandler et al.
5,104,333 A 4/1992 Hatagishi et al.
5,178,554 A 1/1993 Siemon et al.
5,186,647 A 2/1993 Denkmann et al.
5,295,869 A 3/1994 Siemon et al.
5,299,956 A 4/1994 Brownell et al.
5,300,734 A 4/1994 Suzuki
5,310,363 A 5/1994 Brownell et al.
5,326,284 A 7/1994 Bohbot et al.
5,362,257 A 11/1994 Neal et al.
5,391,095 A 2/1995 Born
5,414,393 A 5/1995 Rose et al.
5,432,484 A 7/1995 Klas et al.
5,435,752 A 7/1995 Siemon et al.
5,488,201 A 1/1996 Liu
5,586,914 A 12/1996 Foster, Jr. et al.
5,647,767 A 7/1997 Scheer et al.

(Continued)

FOREIGN PATENT DOCUMENTS

AT 408 820 10/2008

(Continued)

*Primary Examiner* — Gary F. Paumen
(74) *Attorney, Agent, or Firm* — Lipsitz & McAllister, LLC

(57) ABSTRACT

An electrical plug connector comprises a connection module having a plurality of contact elements for establishing an electrical connection to corresponding contact elements of a socket connector, and a terminal module having a plurality of terminal elements, each for connecting a conductor of a cable. The terminal module is adapted to be detachably connected to the connection module in order to establish an electrical connection between each of the terminal elements and a contact element. The connection module comprises a housing into which the terminal module can be inserted, and a strain relief which is connected to the housing and engages over the terminal module, wherein a cable connected to the terminal module is adapted to be fixed to the connection module by means of the strain relief.

24 Claims, 8 Drawing Sheets

U.S. PATENT DOCUMENTS

| | | | | |
|---|---|---|---|---|
| 5,700,167 | A | 12/1997 | Pharney et al. | |
| 5,941,734 | A | 8/1999 | Ikeda et al. | |
| 5,967,853 | A | 10/1999 | Hashim | |
| 5,971,796 | A | 10/1999 | Duhr | |
| 6,010,354 | A * | 1/2000 | Cunningham | 439/417 |
| 6,083,031 | A * | 7/2000 | Kuo | 439/362 |
| 6,089,923 | A | 7/2000 | Phommachanh | |
| 6,095,852 | A | 8/2000 | Gregory, II | |
| 6,123,572 | A * | 9/2000 | Ishii et al. | 439/465 |
| 6,157,542 | A | 12/2000 | Wu | |
| 6,165,023 | A | 12/2000 | Troutman et al. | |
| 6,179,667 | B1 | 1/2001 | Espenshade et al. | |
| 6,305,950 | B1 | 10/2001 | Doorhy | |
| 6,319,070 | B1 | 11/2001 | Tan | |
| 6,333,472 | B1 | 12/2001 | Weatherley | |
| 6,371,793 | B1 | 4/2002 | Doorhy et al. | |
| 6,379,157 | B1 | 4/2002 | Curry et al. | |
| 6,394,844 | B1 | 5/2002 | Frias Valero et al. | |
| 6,416,364 | B1 | 7/2002 | Shi et al. | |
| 6,464,541 | B1 | 10/2002 | Hashim et al. | |
| 6,497,588 | B1 | 12/2002 | Scharf et al. | |
| 6,520,808 | B2 | 2/2003 | Forbes et al. | |
| 6,558,185 | B1 * | 5/2003 | Stockel et al. | 439/465 |
| 6,579,128 | B1 | 6/2003 | Wu | |
| 6,684,179 | B1 | 1/2004 | David | |
| 6,840,779 | B2 | 1/2005 | Eberle et al. | |
| 6,966,798 | B1 | 11/2005 | Wu | |
| 7,040,925 | B2 | 5/2006 | Beerwerth et al. | |
| 7,249,979 | B2 | 7/2007 | Gerber et al. | |
| 7,540,789 | B2 | 6/2009 | Gerber et al. | |
| 7,559,790 | B2 | 7/2009 | Boeck et al. | |
| 7,578,695 | B2 | 8/2009 | Boeck et al. | |
| 7,604,515 | B2 | 10/2009 | Siemon et al. | |
| 7,689,089 | B2 | 3/2010 | Wagner et al. | |
| 7,815,445 | B2 * | 10/2010 | Wu et al. | 439/99 |
| 2002/0009930 | A1 | 1/2002 | Chang | |
| 2003/0157842 | A1 | 8/2003 | Arnett et al. | |
| 2003/0171024 | A1 | 9/2003 | Mossner et al. | |
| 2004/0203292 | A1 | 10/2004 | Eberle et al. | |
| 2004/0209523 | A1 | 10/2004 | Milner et al. | |
| 2005/0118881 | A1 | 6/2005 | Aekins et al. | |
| 2005/0136747 | A1 | 6/2005 | Caveney et al. | |
| 2005/0153580 | A1 | 7/2005 | Schilling | |
| 2005/0159036 | A1 | 7/2005 | Caveney et al. | |
| 2005/0176302 | A1 | 8/2005 | Beerwerth et al. | |
| 2006/0183359 | A1 | 8/2006 | Gerber et al. | |
| 2007/0190656 | A1 | 8/2007 | Crain et al. | |
| 2007/0202752 | A1 | 8/2007 | Schumann et al. | |
| 2008/0057793 | A1 | 3/2008 | Gerber et al. | |
| 2008/0096417 | A1 | 4/2008 | Boeck et al. | |
| 2008/0200059 | A1 | 8/2008 | Boeck et al. | |
| 2009/0147495 | A1 | 6/2009 | Hetzer et al. | |
| 2010/0015858 | A1 | 1/2010 | Gerber et al. | |
| 2010/0233900 | A1 * | 9/2010 | Gimbel | 439/467 |

FOREIGN PATENT DOCUMENTS

| | | |
|---|---|---|
| DE | 691 15 863 | 5/1996 |
| DE | 196 49 668 | 5/1998 |
| DE | 200 12 572 | 2/2001 |
| DE | 199 38 367 | 3/2001 |
| DE | 100 51 097 | 3/2002 |
| DE | 102 42 143 | 5/2004 |
| DE | 10 2005 038 540 | 1/2007 |
| DE | 10 2006 049 563 | 4/2008 |
| DE | 10 2007 008 465 | 8/2008 |
| EP | 0 982 815 | 3/2000 |
| EP | 1 096 620 | 5/2001 |
| EP | 1 693 933 | 8/2006 |
| WO | 02/17442 | 2/2002 |
| WO | 2008/025180 | 3/2008 |

* cited by examiner

ELECTRICAL PLUG CONNECTOR

This application is a continuation of international application number PCT/EP2009/061503 filed on Sep. 4, 2009 and claims the benefit of German application No. 10 2008 064 535.4 filed Dec. 19, 2008.

The present disclosure relates to the subject matter disclosed in international application number PCT/EP2009/061503 filed on Sep. 4, 2009 and German application No. 10 2008 064 535.4 of Dec. 19, 2008, which are incorporated herein by reference in their entirety and for all purposes.

BACKGROUND OF THE INVENTION

The invention relates to an electrical plug connector comprising a connection module having a plurality of contact elements for establishing an electrical connection to corresponding contact elements of a socket connector, and a terminal module having a plurality of terminal elements, each for connecting a conductor of a cable, wherein the terminal module is adapted to be detachably connected to the connection module in order to establish an electrical connection between each of the terminal elements and a contact element.

Plug connectors of this type are known from EP 1 693 933 A1. By utilization of these plug connectors, it is possible to establish an electrical connection between a cable, in particular a telephone or data transmission cable, and a socket connector. Plug connectors of this type come with an internationally standardized arrangement of the contact elements, for example according to the IEC 60503-7-5 standard. These plug connectors are often also referred to as RJ45 connectors. It is desirable for the connection of the cable to the plug connector to be realized without requiring a special tool, so that the assembler can connect the cable to the connector plug simply at the job site. To this end, EP 1 693 933 A1 proposes the use of a terminal module including terminal elements to which the conductors of the cable can be connected. The terminal module with the conductors connected thereto can then be combined with a connection module having the contact elements, so that an electrical connection is established between the terminal elements and the contact elements. In a further assembly step, a sheet metal shield is then slid over the connection module and terminal module. Subsequently, an outer housing which has been previously slid over the cable is slid over the terminal module and the sheet metal shield which engages around the terminal module. Finally, a union nut is then screwed onto the rear end area of the outer housing. The cable is thereby fixed to the plug connector.

SUMMARY OF THE INVENTION

In accordance with an embodiment of the invention, an electrical plug connector is provided which can be connected to the cable more easily without requiring a special tool.

In accordance with an embodiment of the invention, the electrical plug connector comprises a connection module comprising a housing into which the terminal module can be inserted, and a strain relief which is connected to the housing and engages over the terminal module, wherein a cable connected to the terminal module is adapted to be fixed to the connection module by means of the strain relief.

In the plug connector in accordance with the invention, the individual conductors of the cable can be connected to the terminal elements of the terminal module. Once the cable has been connected, the terminal module can be inserted into the housing of the connection module. This establishes an electrical connection between the terminal elements of the terminal module and the contact elements of the connection module. In order to ensure that the connection between the terminal module and the connection module cannot become detached accidentally, the connection module is provided with a strain relief. The strain relief is connected to the housing of the connection module, engages over the terminal module and can be fixed to the cable. Thus, all that is required after inserting the terminal module with the cable connected thereto into the housing of the connection module is to fix the strain relief (which is mechanically connected to the housing) to the cable. The strain relief engages over the terminal module, starting from the housing; therefore, fixing the strain relief to the cable simultaneously causes the terminal module to be undisplaceably held in position within the housing of the connection module. Assembly of the plug connector to the cable can thus be carried out simply without needing a special tool.

It is advantageous for the strain relief to be adapted to be detachably connected to the cable and, once the connection between the strain relief and the cable is detached, for the terminal module to be removable from the housing of the connection module. This allows the connection module to be used several times. The terminal module can be separated from the connection module. The cable can then be separated from the terminal module, and the connection module can be re-used after a new terminal module has been inserted.

It is particularly advantageous for the connection between the strain relief and the cable to be detachable without requiring a special tool. For example, it may be provided for a simple screwdriver to be all that is needed for detaching the connection between the strain relief and the cable.

In a preferred embodiment of the invention, the strain relief has a cable support element connected in rigid manner to the housing and a cable clamping element connected in articulated manner to the housing, the cable clamping element being adapted to be secured in at least one clamping position. In connecting the cable to the plug connector, the cable can be clamped between the cable clamping element and the cable support element. To this end, the cable clamping element is adapted to be secured in at least one clamping position. It is advantageous for the cable support element to be integrally connected to the housing. For example, the housing and the cable support element may be a one-piece component made of a metal material.

It is particularly advantageous for the cable clamping element to be adapted to be secured in a plurality of positions, for example in three positions. This provides the possibility of connecting cables of different thicknesses to the plug connector. The cable clamping element can be secured in an appropriate clamping position depending on the cable diameter.

For example, it may be provided for cables having a diameter between 5 mm and 8.5 mm to be connectable to the plug connector. Despite the different cable diameters, the cables can be reliably fixed to the plug connector by means of the strain relief, and an electrical connection to the corresponding socket connector can be established via the plug connector.

In an advantageous embodiment of the invention, a lid is mounted for pivotal movement on the housing of the connection module, said lid being movable back and forth between a closed position and an open position and adapted to be releasably secured in its closed position. In its open position, the lid exposes the interior of the housing, so that the terminal module can be inserted into the housing. In its closed position, the lid covers the interior of the housing, thereby protecting the terminal module and the end area of the cable directly adjacent to the terminal module from mechanical damage.

Preferably, the lid in its closed position is adapted to be detachably connected to the cable support element. For example, it may be provided for the lid to be adapted to be snapped together with the cable support element. To this end, the lid and the cable support element may have cooperating snap elements arranged thereon. The releasable securement of the lid allows the terminal module with the cable connected thereto to be removed from the housing at any time. To this end, all that is needed is to release the securement and pivot the lid to its open position.

Preferably, the cable clamping element is held for pivotal movement on the lid. It can be pivoted together with the lid between the open position of the lid and the closed position of the lid. In the closed position of the lid, the cable can then be fixed to the plug connector by means of the cable support element.

In an advantageous embodiment, the securement of the cable clamping element in at least one clamping position is realized by the cable clamping element being adapted to be snapped together with the lid. To this end, the lid and the cable clamping element may have cooperating snap elements arranged thereon. In particular, it may be provided for the cable clamping element to be adapted to be snapped into engagement with the lid in a plurality of clamping positions. By way of example, the lid or the cable clamping element may be provided with a plurality of snap protrusions, each cooperating with a complementary snap protrusion or a complementary snap recess provided on the cable clamping element or the lid.

Generally, the cable not only has a plurality of conductors via which electrical signals can be transmitted but also comprises an electrically conductive shielding surrounding the conductors, for example a braided shield or a mesh shield which can be connected to ground potential. The shielding protects the conductors from electromagnetic interference pulses. In order to ensure reliable shielding also within the plug connector, an advantageous embodiment provides for the housing to be configured to be electrically conductive, and a shield-contacting part which is electrically connected to the housing can be pressed against the shielding of the cable by the strain relief. In such an embodiment of the invention, mechanically fixing the strain relief to the cable simultaneously enables an electrical connection to be formed between the shield-contacting part of the plug connector and the shielding of the cable. To this end, all that is required is to expose the shielding of the cable prior to connecting the cable to the terminal module. When the terminal module is inserted into the housing of the connection module (once the cable with its shielding exposed has been connected thereto) and when thereupon the cable is fixed to the plug connector by means of the strain relief, then the shield-contacting part is pressed against the shielding of the cable by the strain relief, and with the shield-contacting part being electrically conductive, a conductive connection is established between the shielding of the cable and the electrically conductive housing of the plug connector without a special tool being required for this.

Preferably, the shield-contacting part is arranged on the inside of the cable clamping element. It may be connected in rigid manner to the cable clamping element. It is, however, particularly advantageous for the shield-contacting part to form a discrete component. For example, it may be provided for the shield-contacting part to form a metal casting which is mounted in a floating manner on the housing of the connection module and can be pressed against the cable by the cable clamping element of the strain relief. As has been explained above, the cable clamping element can be secured in at least one clamping position, thereby also enabling the shield-contacting part to be immovably fixed to the shielding arranged outside of the cable.

Originally, plug connectors of the RJ45 type were used only for transmitting telephone signals which operate at a relatively low frequency. However, owing to the increasingly widespread use of computers, data signals at considerably higher frequencies are also transmitted via RJ45 connectors. This entails the risk of the quality of signal transmission being adversely affected by unwanted signal coupling between different conductor pairs. Therefore, the performance of a plug connector in respect of what is known as crosstalk is of great importance in the assessment of its quality. In a preferred embodiment of the invention, signal coupling between different conductor pairs can be kept particularly low by the terminal module having a plurality of chambers, each receiving a pair of conductors. The chambers are mechanically and preferably also electrically isolated from one another. For example, they may be shielded from each other. Providing the chambers reduces signal coupling between different conductor pairs. Moreover, the provision of chambers, each receiving a pair of conductors, is advantageous in that the connection of the conductors to the terminal module can be realized very simply. In particular, it reduces the risk of misconnecting the conductors. The assembler needs only to ensure that the conductor pairs, each transmitting an electrical signal, are inserted into a chamber.

To keep the signal coupling between different pairs of conductors low, it is advantageous for the terminal module to have a circuit board on which the terminal elements are held, the circuit board having contact members, each electrically connected to a terminal element and adapted to be contacted by a contact element of the connection module. The circuit board may comprise conductor tracks in the usual manner, said conductor tracks being adapted for transmitting the electrical signals from the terminal elements to the contact members. In addition, the circuit board may carry capacitors and/or inductors to compensate for possible signal coupling between different pairs of conductors.

It is particularly advantageous for the circuit board to have at least two planes of electrical conductor tracks, for example on its top side and on its bottom side. Circuit boards of this type are known to the person skilled in the art as "multilayers".

It is particularly advantageous for terminal elements to be held on both the top side and the bottom side of the circuit board. This enables the terminal module to be configured in a particularly compact form.

Preferably, the terminal elements are press-fit into the circuit board. This enables the terminal elements to have a high mechanical loadability without compromising the electrical connection between the terminal elements and the conductor tracks of the circuit board. Moreover, the press-fit mounting of the terminal elements in the circuit board allows the manufacturing cost of the terminal module to be kept down.

By way of example, the terminal elements may be configured as cutting terminals. However, it is particularly advantageous for the terminal elements to be configured as piercing contacts. Such piercing contacts have a piercing tip, each piercing tip penetrating a conductor of the cable, thereby establishing an electrical contact.

It is advantageous for the contact elements of the connection module to be adapted for direct electrical connection to the contact members of the circuit board. For example, it may be provided for the contact members to be configured in the form of contact pads and for the contact elements of the connection module to each comprise a contact spring which is adapted to be placed in contact with a contact pad of the circuit board, thereby undergoing elastic deformation. Contacting of the contact elements on the circuit board is thus effected by force-locked engagement. An electrical signal from a conductor of the cable can thus be transmitted directly to the contact element via the terminal element and the circuit board. When the terminal module is inserted into the housing of the connection module, each of the contact springs of the contact elements can electrically and mechanically contact a contact pad of the circuit board, whereby the contact springs are elastically deformed.

In a particularly advantageous embodiment of the invention, the terminal module has at least one terminal block with openings, each opening adapted to have a conductor of the cable inserted therein and aligned with a terminal element, the terminal block being held on the circuit board for movement between an assembly position and a contact position, the terminal elements in the assembly position of the terminal block exposing the openings for insertion of the conductors, and the terminal elements in the contact position of the terminal block extending into the openings to establish an electrical connection between a conductor and a terminal element in each case. With such an embodiment, connecting the conductors to the terminal module only requires inserting each of the conductors into an opening of the at least one terminal block, which is initially in its assembly position, and then moving the terminal block to its contact position. In this position, a terminal element extends into each opening of the terminal block and establishes an electrical connection to the respective conductor which has been previously inserted into the opening. The terminal block may be configured as a moulded article made of a plastic material and may carry indicia which assist the assembler in inserting the conductors with the proper assignment to the openings.

It is particularly advantageous for the terminal module to have two terminal blocks between which is arranged the circuit board carrying terminal elements on its top side and bottom side. The use of two terminal blocks between which the circuit board is interposed is advantageous in that once the conductors have been inserted into the openings of the terminal blocks, the terminal blocks can be urged against each other, so that they transition from their assembly position to their contact position, thereby causing the electrical connection between the conductors and the terminal elements to be established. In this transition, the mechanical load imposed on the circuit board sandwiched between the two terminal blocks is very low because the terminal blocks are supported against each other. The risk of damage to the circuit board or to the terminal elements during the transition of the terminal blocks from their assembly position to their contact position is thus kept very low. Furthermore, such a configuration of the plug connector facilitates the connection of a cable without having to resort to special tools.

It is favourable for the circuit board to have arranged thereon a guiding part protruding over the top side and bottom side of the circuit board, the two terminal blocks being held for displacement on the guiding part, the guiding part extending into centrally arranged recesses of the terminal blocks. The terminal blocks can slide along the guiding part as they transition from their assembly position to their contact position.

It is particularly advantageous for the terminal blocks in the assembly position to be adapted to be fixed to the guiding part. For example, it may be provided for the terminal blocks in the assembly position to be releasably snapped together with the guiding part. Once the conductors have been inserted into the openings of the terminal blocks, the terminal blocks can be urged against each other, thereby disengaging the snap engagement between the guiding part and the terminal blocks. It is particularly advantageous for the terminal blocks to be also adapted to be snapped into engagement with the guiding part when they are in their contact position.

The guiding part may be adapted to extend into a recess of the terminal blocks. Preferably, the recess is centrally arranged in the respective terminal block. In particular, it may be provided for each terminal block to have four openings for inserting a first conductor pair and a second conductor pair, and the recess provided for the guiding part may be arranged between the openings for the first conductor pair and the openings for the second conductor pair. In the contact position of the terminal block, the guiding part extending into the recess thus separates the first conductor pair from the second conductor pair. Each of the terminal blocks thus defines two chambers which are separated from each other by the guiding part.

It is particularly advantageous for the guiding part to form a partition wall protruding vertically between two pairs of terminal elements from the circuit board.

The guiding part configured as a partition wall can form an electrical shielding which is arranged between two pairs of terminal elements, thereby reducing signal coupling between different conductor pairs.

As previously mentioned, the terminal module can be inserted into the housing of the connection module. To this end, the housing may form a compartment having a compartment front section relative to the direction of insertion of the terminal module, said compartment front section receiving a circuit board front area of the circuit board where the contact pads are arranged, and a compartment rear section receiving a circuit board rear area where the terminal elements and the at least one terminal block are held. The contact springs of the contact elements may extend into the compartment front section, so that each of the contact springs, on insertion of the terminal module into the compartment, can electrically and mechanically contact a contact pad arranged in the circuit board front area.

Both the circuit board and the compartment may have a stepped configuration by the compartment front section transitioning into the compartment rear section via a step and by the circuit board front area transitioning into the circuit board rear area via a step, the compartment's step being adapted to form a stop for the circuit board's step when the terminal module is inserted into the housing.

Preferably, the compartment walls of the compartment front section are, at least in portions thereof, made of an electrically insulating material, for example a plastic material.

In an advantageous embodiment of the invention, the walls of the compartment front section form a guide for the circuit board front section. This facilitates insertion of the terminal module into the housing of the connection module and ensures that each contact spring of the contact elements, in the inserted position of the terminal module, makes contact with a contact pad of the circuit board.

The following description of preferred embodiments, taken in conjunction with the drawings, serves to explain the invention in greater detail.

DETAILED DESCRIPTION OF THE INVENTION

Figure 1:
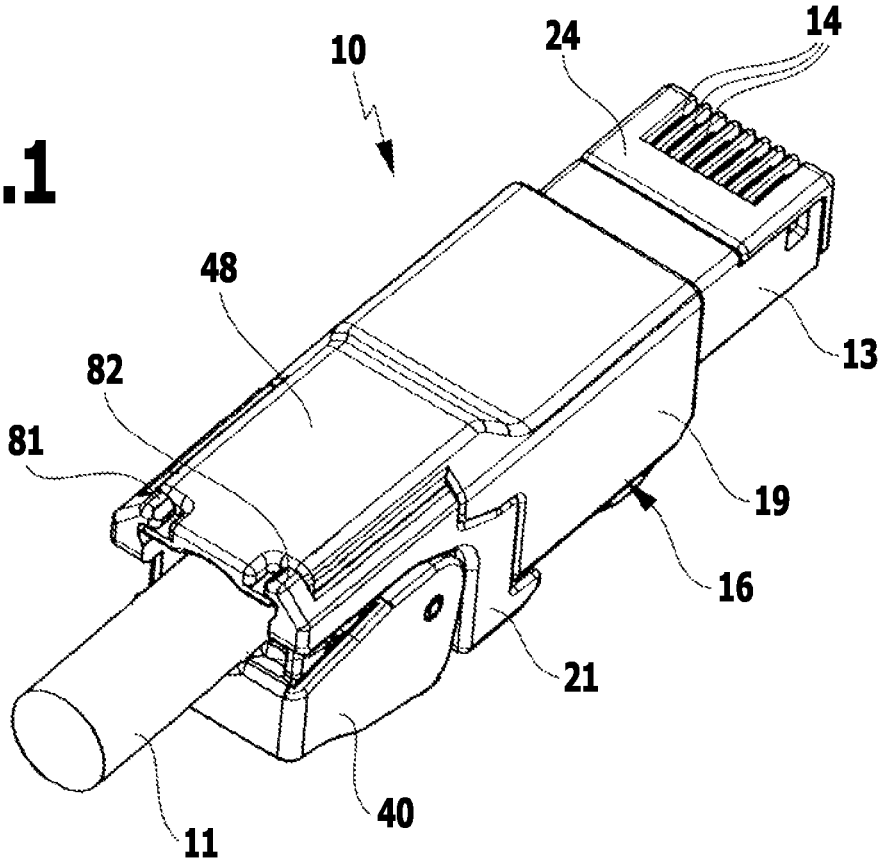
FIG. 1: is a perspective view of an electrical plug connector in accordance with the invention.

The drawing is a schematic view illustrating a plug connector 10 in accordance with the invention, said plug connector being adapted to have a cable 11 connected to it and cooperating with a socket connector known per se, not shown in the drawing. To this end, the plug connector 10 has a plug head 13 with a plurality of contact elements 14. In the embodiment illustrated, eight contact elements 14 are arranged side by side. The plug head 13 can be inserted into a complementary-shaped slot of the socket connector in order to establish a detachable connection. Contact elements of the socket connector protrude into the slot, said contact elements being adapted to make electrical contact with the contact elements 14 of the plug connector 10, so that an electrical connection can be established between the plug connector 10 and the socket connector in the usual manner.

The plug connector 10 has a connection module 16 and a terminal module 17. This is shown in particular in FIG. 4. The connection module 16 comprises the plug head 13 with the contact elements 14, and the terminal module 17 is adapted to have the cable 11 connected thereto.

Figure 2:
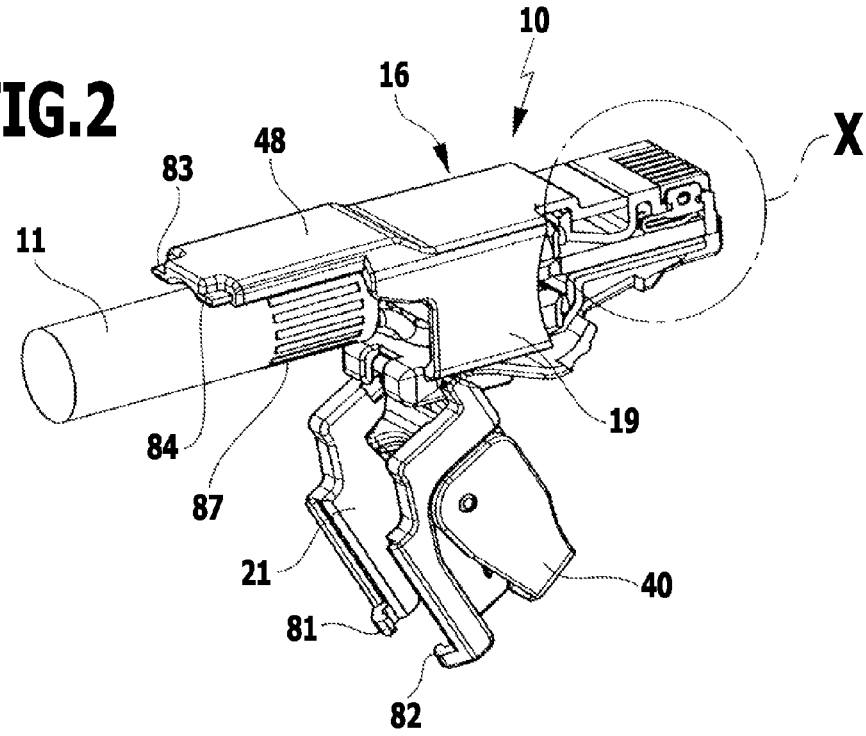
FIG. 2: is a perspective, partially cut-away view of the plug connector shown in FIG. 1 with a lid in an open position.
Figure 4:
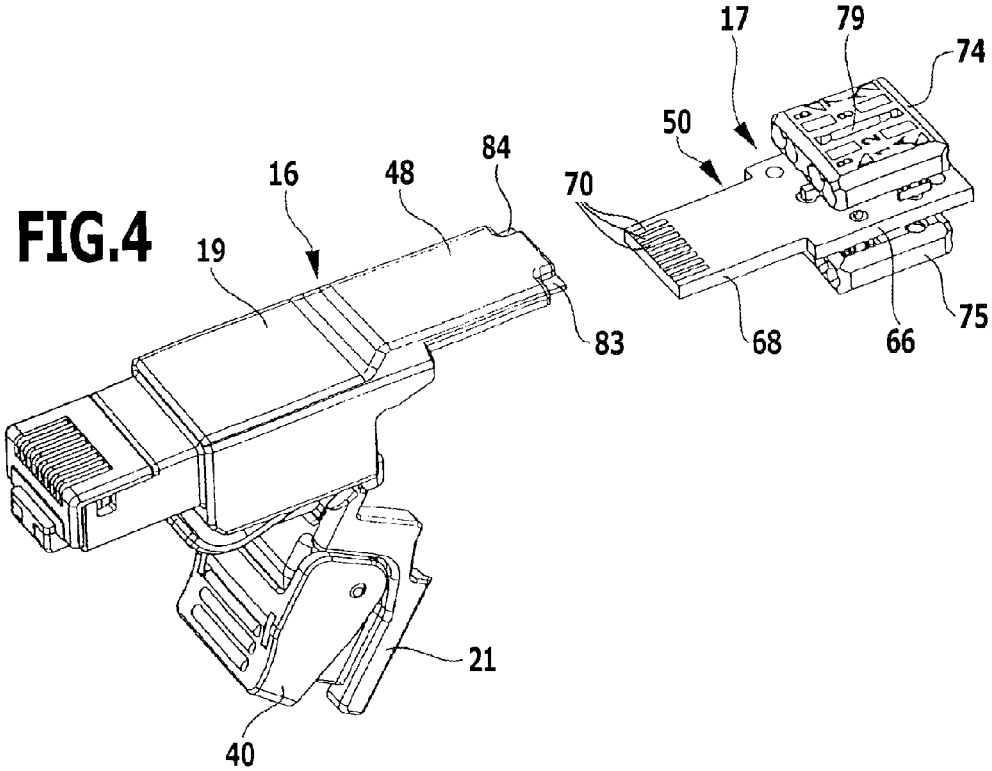
FIG. 4: is a perspective view of the plug connector shown in FIG. 1 in the as-delivered condition and as comprising a connection module and a terminal module.
Figure 5:
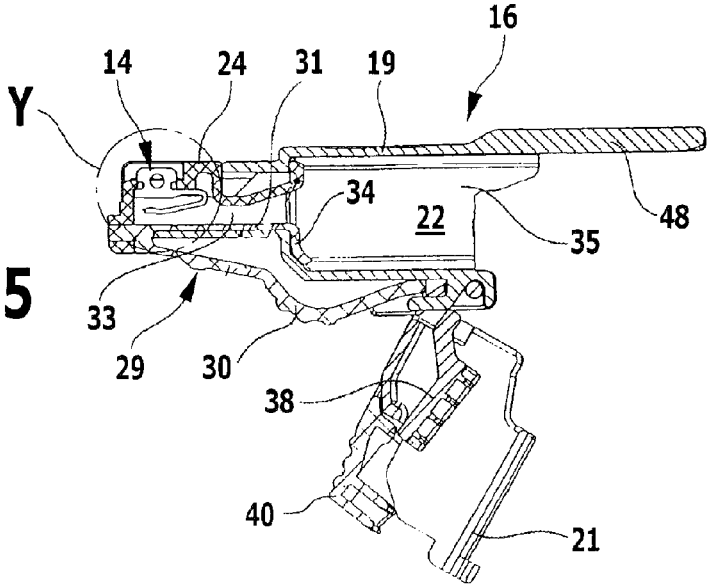
FIG. 5: is a sectional view of the connection module shown in FIG. 4.
Figure 7:
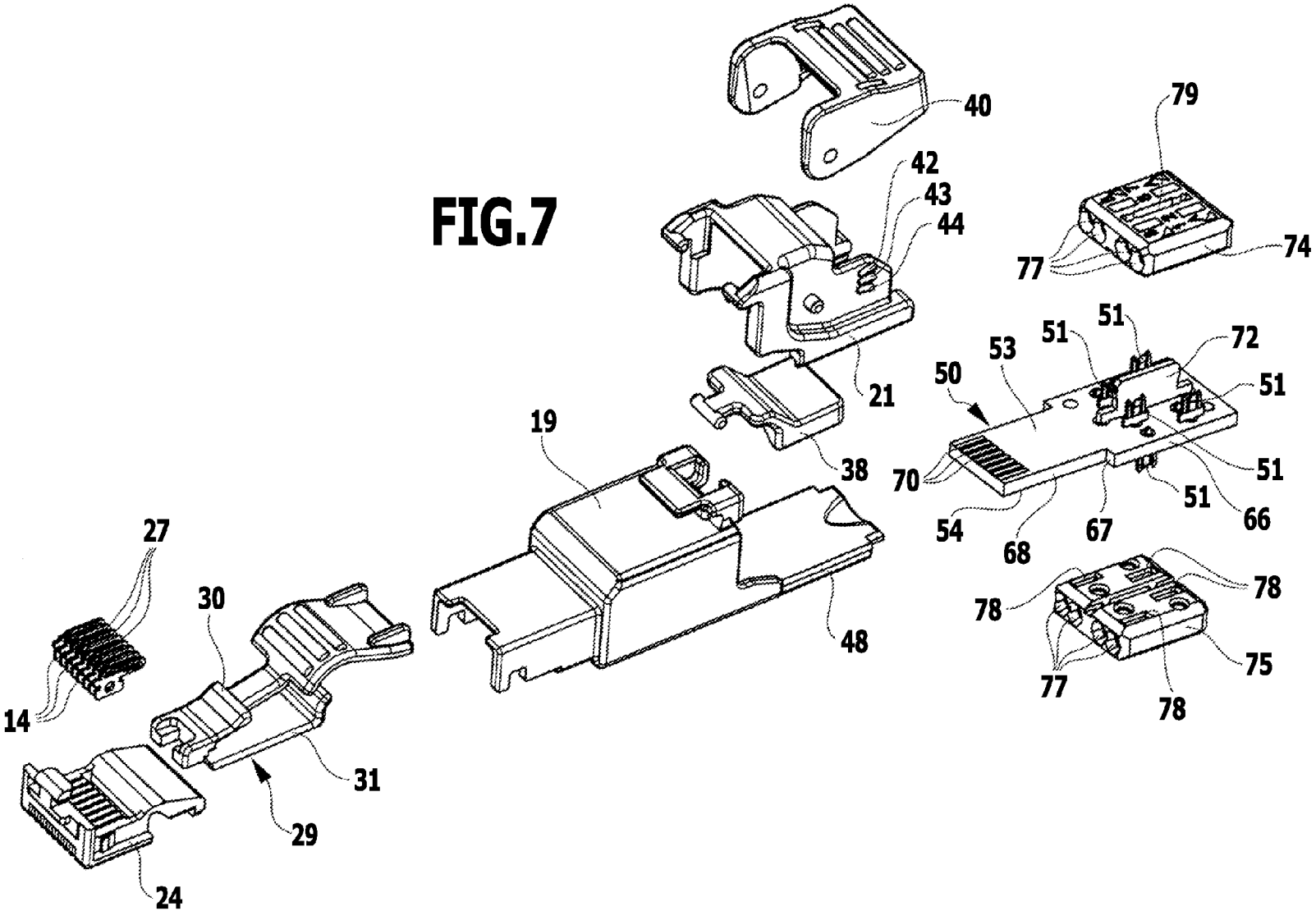
FIG. 7: is a view of the plug connector shown in FIG. 1, in the nature of an exploded view.

As is shown in particular in FIGS. 5 and 7, the connection module 16 has a housing 19 on which a lid 21 is pivotally mounted. The lid 21 can be moved back and forth between an open position as shown in FIGS. 2, 4 and 5, and a closed position shown in FIG. 1. In its open position, the lid 21 exposes a housing interior space 22 into which the terminal module 17 can be inserted and from which the terminal module 17 can also be removed again when necessary. The housing 19 is made of a metal material, for example a die casting metal material such as die cast zinc. The lid 21 is also made of a metal material, preferably a die casting material, for example die cast zinc.

Figure 6:
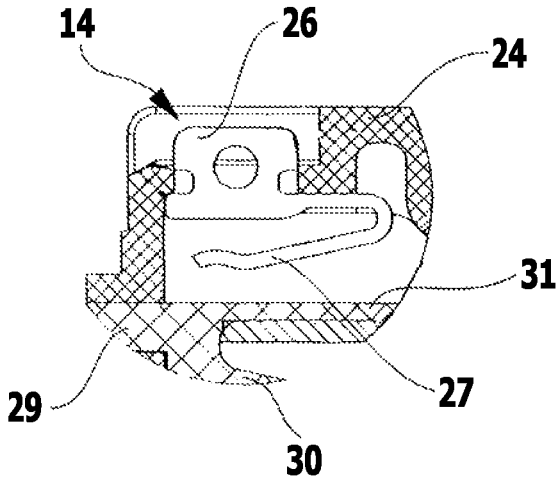
FIG. 6: is an enlarged view of detail Y shown in FIG. 5.

The contact elements 14 are held on an electrically insulating carrier part 24 which is fixed at a front end of the housing 19 and is made of an electrically insulating plastic material. The contact elements 14 are press-fit into the carrier part 24 and have a cantilevered contact head 26 adapted to be contacted by a corresponding contact element of the socket connector, an elastically deformable contact spring 27 protruding from the bottom side of said contact head. This is shown in particular in FIG. 6.

Held on the housing 19, in addition to the carrier part 24, is an attachment part 29 which, like the carrier part 24, is made of an electrically insulating plastic material and which has a spring-loaded latch 30 protruding outwardly from the housing 19 and has a cover 31 which can be inserted into the housing 19 at a face end thereof. By means of the latch 30 of the attachment part 29, the plug connector 10 can be mechanically snapped together with a corresponding socket connector.

Within the housing interior space 22, the carrier part 24 and the cover 31 of the attachment part 29 define a compartment front section 33 therebetween. In the direction facing away from the contact elements 14, a compartment rear section 35 adjoins the compartment front section 33 via a step 34 formed in the compartment.

As is shown in particular in FIG. 7, arranged on the inside of the lid 21 is a shield-contacting element 38 which is mounted in a floating manner on the housing 19 and, like the housing 19 and the lid 21, is made of a metal material, preferably a die casting material such as die cast zinc.

Mounted for pivotal movement on the outside of the lid 21 is a cable clamping element 40 made of an electrically insulating plastic material. The cable clamping element 40 is adapted to be snapped together with the lid 21 in a plurality of clamping positions (i.e. three in the embodiment shown). To this end, three spaced-apart snap protrusions 42, 43, 44 are integrally formed on each of opposed outer sides of the lid 21, said snap protrusions cooperating with a snap projection 46 integrally formed inside of the cable clamping element 40. This is shown in particular in FIGS. 15 to 18.

The cable clamping element 40 cooperates with a plate-like cable support element 48 which is integrally connected to the housing 19. Cable support element 48 and housing 19 form a one-piece die casting which is adapted to have the cable 11 clamped therebetween. This will be explained in greater detail below.

The terminal module 17 comprises a circuit board 50 within which the terminal elements 51 are press-fit mounted. Four terminal elements 51 project upward from the top side 53 of the circuit board 50, and another four terminal elements 51 project downward from the bottom side 54 of the circuit board 50. The terminal elements 51 are configured as what are known as piercing contacts, each comprising a piercing tip. The cable 11 has a total of eight conductors 56 to 63, with the conductors 56 and 57 forming a first conductor pair for transmitting an electrical signal. The conductors 58 and 59 form a second conductor pair, the conductors 60 and 61 form a third conductor pair, and the conductors 62 and 63 form a fourth conductor pair, each adapted for transmitting an electrical signal. One of the conductors 56 to 63 can be contacted by means of each of the eight terminal elements 51. The circuit board 50 in the area of the terminal elements 51 forms a circuit board rear area 66. Said circuit board rear area transitions, via a step 67 formed in the circuit board, into a circuit board front area 68 having a width smaller than the width of the circuit board rear area 66. Arranged in the front end area of the circuit board 50 are a total of eight contact members in the form of contact pads 70, each of which is electrically connected to a terminal element 51 via conductor tracks known per se and therefore not shown in the drawing for the sake of clarity. The conductor tracks are arranged in part on the top side 53 and in part on the bottom side 54 of the circuit board 50.

The circuit board 50 in the circuit board rear area 66 carries a guide element projecting from both the top and the bottom side of the circuit board 50, the guide element being in the form of a partition wall 72. The partition wall 72 is arranged in the circuit board rear area 66 midway between two pairs of terminal elements 51, each serving to connect one pair of conductors 56, 57 and 58, 59 and 60, 61 and 62, 63 respectively.

The partition wall 72 carries a first terminal block 74 on the top side 53 of the circuit board 50 and a second terminal block 75 on the bottom side 54 of the circuit board 50. Both of the terminal blocks 74 and 75 are made of an electrically insulating plastic material and have four openings in the form of longitudinal bores 77. Opening out into each longitudinal bore 77 is a transverse bore 78 which is aligned with a terminal element 51. For the purpose of assembling the terminal blocks 74 and 75 to the partition wall 72, the terminal blocks 74 and 75 each have a central cutout 79 arranged midway (in the longitudinal and transverse direction of the terminal blocks 74, 75) between two pairs of longitudinal bores 77, the partition wall 72 extending into said cutout.

In the as-delivered condition of the plug connector 10, in which the plug connector has not yet been connected to a cable 11, the terminal blocks 74 and 75 are snapped together with the partition wall 72 in an assembly position at a distance from the circuit board 50. In the assembly position, the terminal blocks 74 and 75 are spaced from the top side 53 and bottom side 54 of the circuit board 50 respectively such that the respective terminal elements 51 projecting from the top side and bottom side of the circuit board 50 do not yet extend into the longitudinal bores 77. In the assembly position of the terminal blocks 74 and 75, the conductors 56 to 63 can be inserted into the longitudinal bores 77 without interference from the terminal elements 51. Subsequently, the terminal blocks 74 and 75 can be urged against each other, so that they are transferred to a contact position in which they are positioned at a lesser distance from the circuit board 50. In the contact position, the terminal elements 51 extend laterally into the longitudinal bores 77 via the transverse bores 78, so that the piercing tips of the terminal elements 51 each pierce and make electrical contact with a respective conductor 56 to 63. This provides an electrical connection between the conductors 56 to 63 and the terminal elements 51, these in turn being electrically connected to the contact pads 70 via the conductor tracks (not shown in the drawing).

In the contact position of the terminal block 74, the conductors 56, 57 of the first conductor pair are separated from the conductors 58, 59 of the second conductor pair by means of the partition wall 72. The terminal block 74 is subdivided into two chambers by the partition wall 72, the chambers each receiving a pair of conductors. Correspondingly, the terminal block 75 is also subdivided into two chambers by the partition wall 72, each chamber receiving a pair of conductors. The terminal module 17 has a total of four chambers separated from each other, each for receiving a pair of conductors.

Figure 3:
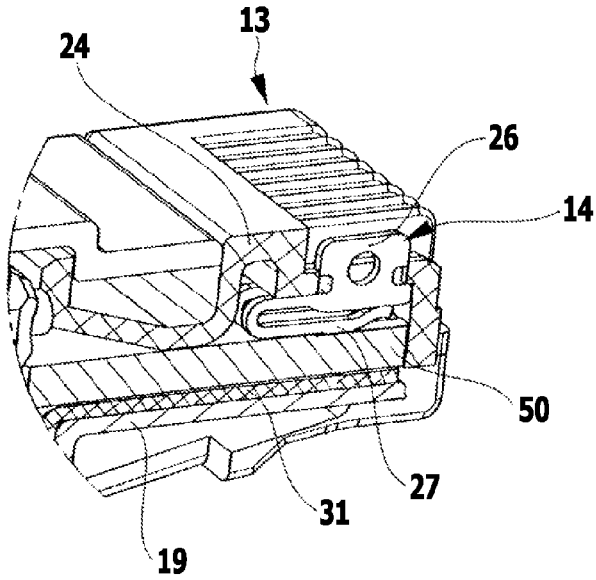
FIG. 3: is an enlarged view of detail X shown in FIG. 2.

As has been explained before, the terminal module 17 can be inserted into the housing interior space 22. In this process, the circuit board front area 68 enters the compartment front section 33, so that each of the contact springs 27 can make electrical and mechanical contact with a contact pad 70, whereby the contact springs 27 are elastically deformed. The circuit board front area 68 rests flat on the electrically insulating cover 31 and is contacted on the top side by the electrically insulating carrier part 24. This is shown in particular in FIG. 3. The compartment front section 33 thus forms a guide for the circuit board 50.

The terminal module 17 can be inserted into the housing interior space 22 all the way until the step 67 of the circuit board comes into contact with the step 34 of the compartment. The compartment's step thus forms a stop for the terminal module 17.

Once the terminal module 17 is inserted into the housing interior space 22, the free edges of the partition wall 72 protruding from the circuit board 50 are in contact with the inside of the housing 19. The partition wall 72, like the housing 19, is electrically conductive and forms an electrical shielding which is arranged between the above-mentioned conductor pairs, shielding them from each other.

After inserting the terminal module 17 with the cable 11 connected thereto into the housing interior space 22, the housing interior space 22 can be closed by means of the lid 21. In its closed position, the lid 21 can be snapped together with the housing 19. To this end, the lid 21 has snap protrusions 81, 82 on opposed outer faces thereof which in the closed position of the lid 21 each extend into complementary-shaped snap recesses 83 and 84 of the cable support element 48 which is integrally connected to the housing 19. After closing the lid 21, the cable clamping element 40 which is pivotally mounted on the lid 21 can be urged against the cable 11 and can be snapped into place in a clamping position adapted to the particular thickness of the cable 11 by means of the snap protrusions 42, 43 and 44 and the snap projection 46 associated therewith. The cable 11 is thereby clamped between the cable clamping element 40 and the cable support element 48. Cable clamping element 40 and cable support element 48 together form a strain relief for the plug connector 10.

The shield-contacting element 38 is arranged on the inside of the cable clamping element 40 and is urged against the cable 11 by the cable clamping element 40. It can thereby make contact with the shielding 87 of the cable 11 which has been exposed prior to connecting the cable 11 to the terminal module 17, so that an electrical connection is established between the electrically conductive housing 19 and the shielding 87. The latter can for example be configured in the form of a braided shield or a mesh shield. Shieldings 87 of this type are known per se to the person skilled in the art.

Figure 8:
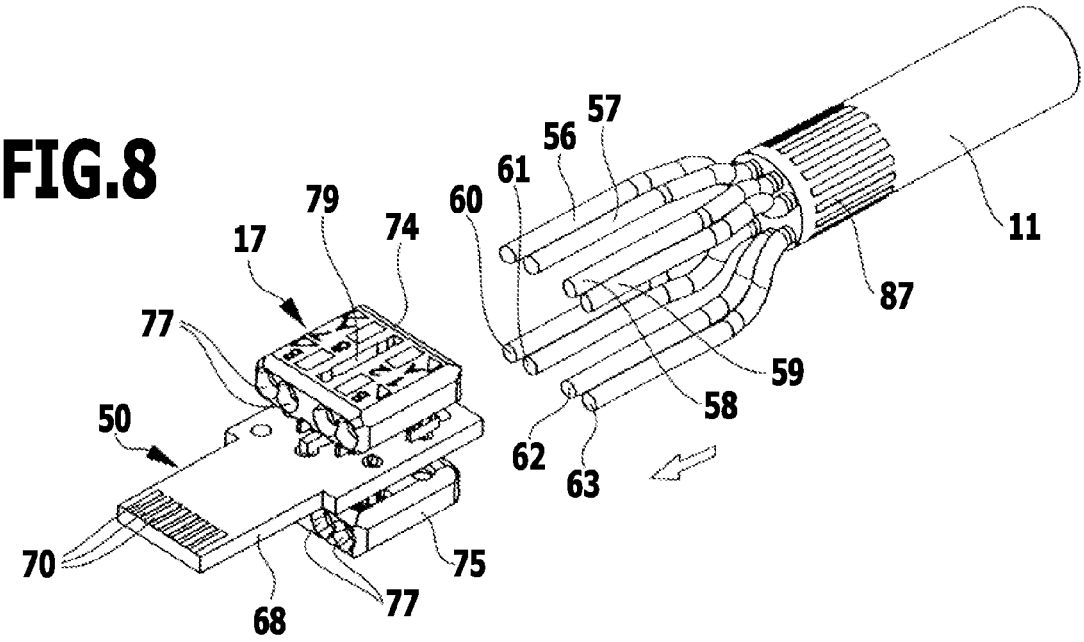
FIG. 8: is a schematic view of the terminal module shown in FIG. 4 in which conductors of a cable are in the process of being inserted into terminal blocks of the terminal module.

Thus, assembling a cable 11 to the plug connector 10 is very simple and can be realized by an assembler at a job site without using a special tool. In a first assembly step, illustrated in FIG. 8, the assembler inserts the conductors 56 to 63 into the longitudinal bores 77 of the terminal blocks 74 and 75, which are initially still in their assembly position. Prior to this, the assembler has exposed the shielding 87 of the cable 11 at an end section thereof.

Figure 9:
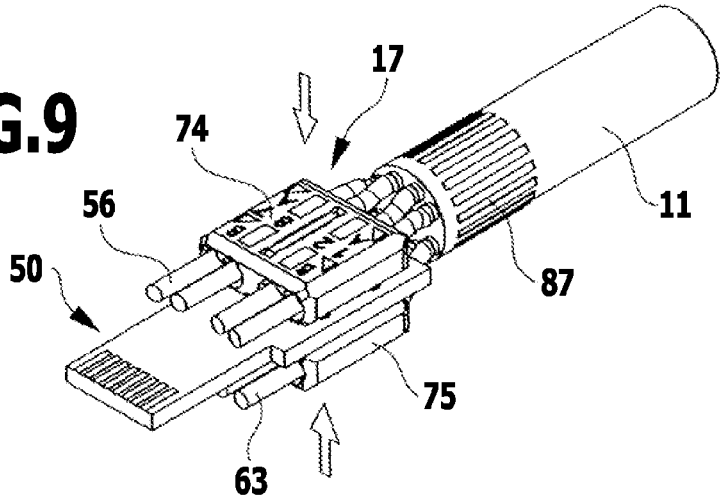
FIG. 9: is a schematic view of the terminal module after insertion of the conductors of the cable into the terminal blocks.
Figure 10:
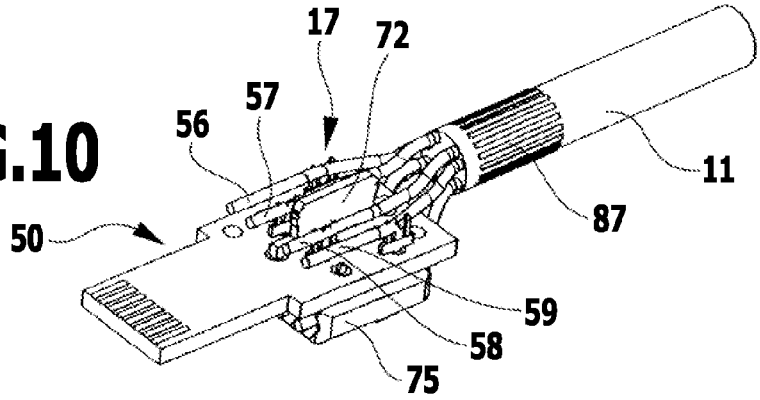
FIG. 10: illustrates the cooperation of the individual conductors of the cable and the terminal elements of the terminal module.

In a second assembly step, as illustrated in FIG. 9, the assembler urges the terminal blocks 74 and 75 against each other with the circuit board 50 interposed therebetween. The terminal blocks 74 and 75 thereby assume their contact position, the terminal elements 51 extending into the longitudinal bores 77 in order to establish an electrical contact between the conductors 56 to 63 and the terminal elements 51.

Figure 11:
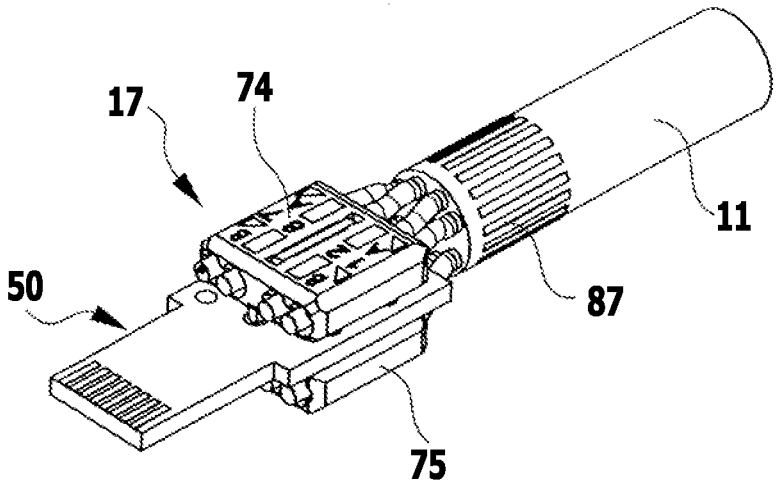
FIG. 11: is a schematic view of the terminal module with the cable connected thereto.
Figure 12:
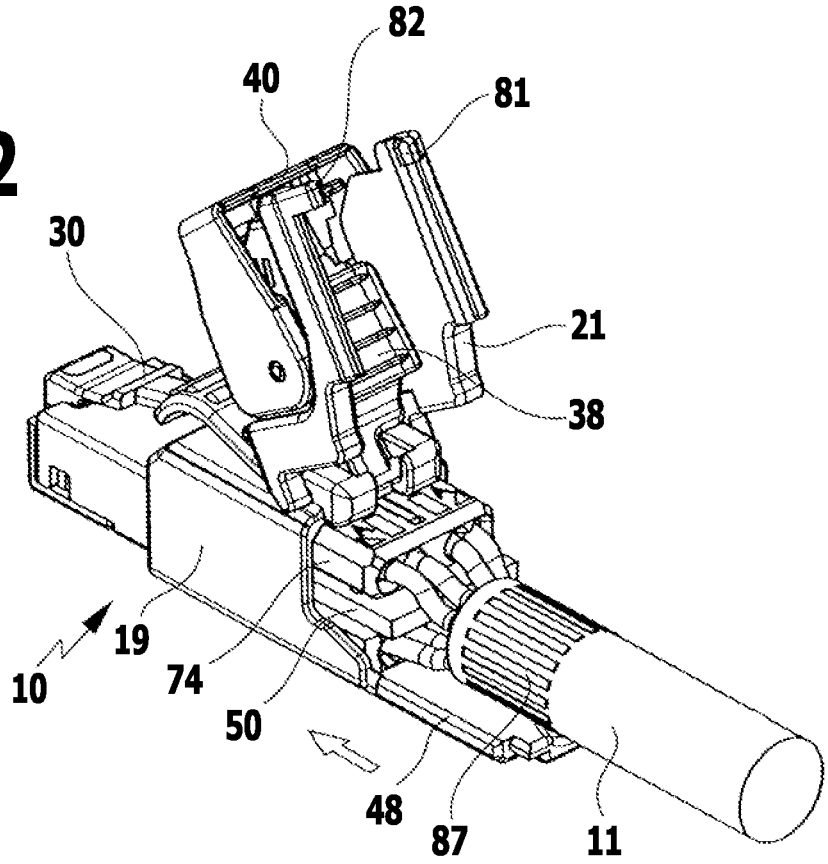
FIG. 12: is a schematic view of the plug connector in which the terminal module with the cable connected thereto is in the process of being inserted into a housing of the connection module.

The end sections of the conductors 56 and 63 protruding beyond the terminal blocks 74 and 75 can then be trimmed, as shown in FIG. 11. In a further assembly step, the assembler can then insert the terminal module 17 into the housing interior space 22, whereby each of the contact springs 27 makes contact with a contact pad of the circuit board 50.

Figure 13:
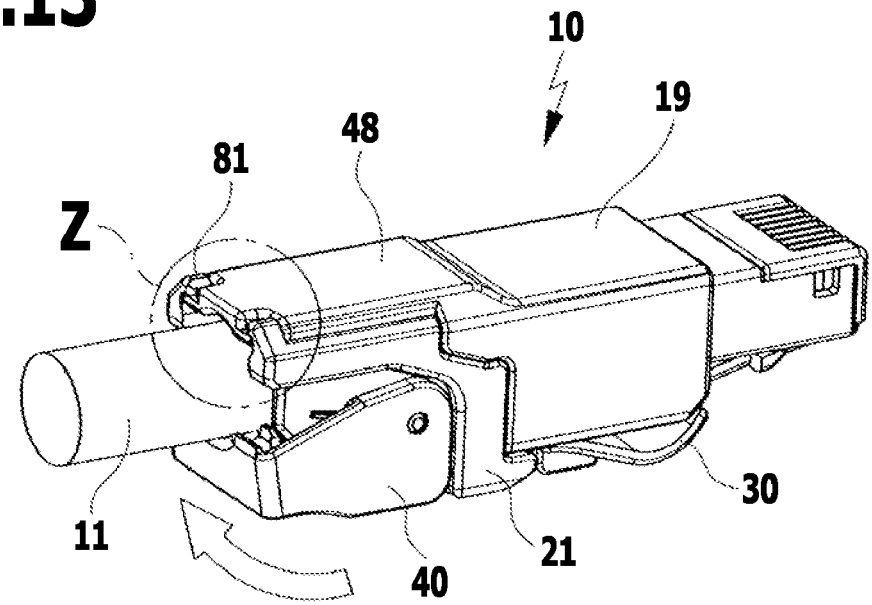
FIG. 13: is a schematic view of the plug connector after insertion of the terminal module into the housing of the connection module.
Figure 14:
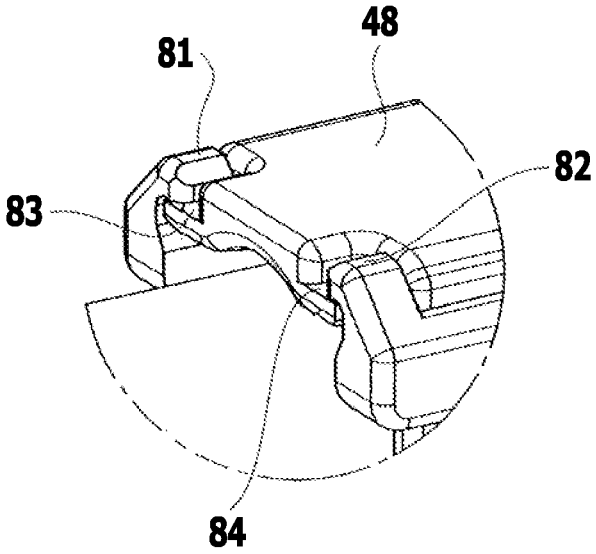
FIG. 14: is an enlarged view of detail Z shown in FIG. 13.
Figure 15:
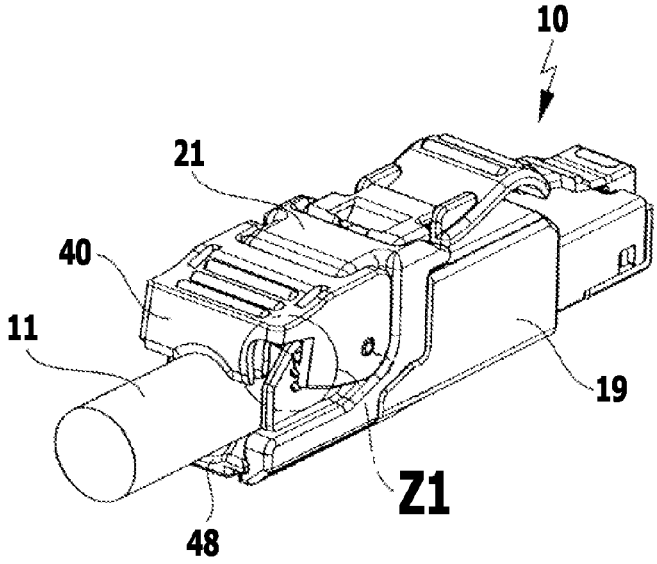
FIG. 15: is a schematic view of the plug connector with the cable connected thereto.
Figure 16:
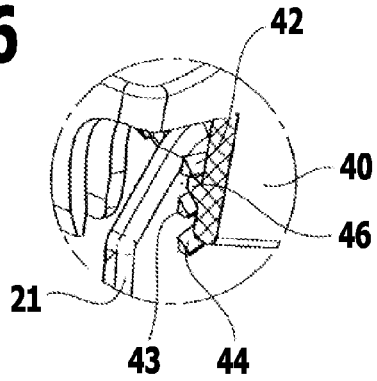
FIG. 16: is an enlarged view of detail Z1 shown in FIG. 15 with a cable clamping element in a first snap position.
Figure 17:
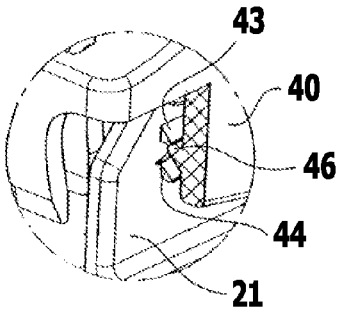
FIG. 17: is an enlarged view of detail Z1 shown in FIG. 15 with the cable clamping element in a second snap position.
Figure 18:
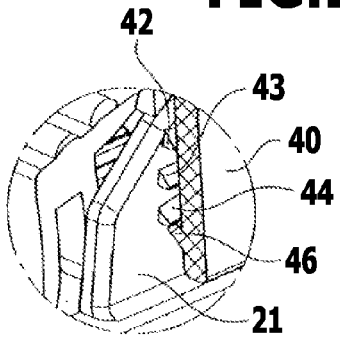
FIG. 18: is an enlarged view of detail Z1 shown in FIG. 15 with the cable clamping element in a third snap position.

In a further assembly step, illustrated in FIG. 13, the assembler can then close the lid 21, whereby the lid 21 in its closed position is snapped together with the cable support element 48, as shown in FIG. 14.

In a final assembly step, the assembler can then press the cable clamping element 40 against the cable 11 and bring it into snap engagement with the lid 21 in a desired snap position, simultaneously causing the shield-contacting element 38 to make electrical contact with the shielding 87. The plug connector 10 is then reliably fixed to the cable 11, an electrical connection existing between each of the conductors 56 to 63 and a contact element 14. The plug connector 10 can then be mated with a socket connector in the usual manner, wherein a mechanically detachable connection can be established between the plug connector 10 and the corresponding socket connector by means of the latch 30 of the attachment part 29.

Thus, assembling a cable 11 to the plug connector 10 is very simple.

When it is desired to detach the connection between the cable 11 and the plug connector 10, the assembler can re-open the lid 21 and subsequently withdraw the terminal module 17 from the housing interior space 22. The terminal module 17 can then be separated from the cable 11 by means of diagonal pliers, and the connection module 16 can be re-used in connection with a different terminal module.

The invention claimed is:

1. Electrical plug connector comprising:

a connection module having a plurality of contact elements for establishing an electrical connection to corresponding contact elements of a socket connector;

a terminal module having a plurality of terminal elements, each for connecting a conductor of a cable;

wherein:

the terminal module is adapted to be detachably connected to the connection module to establish an electrical connection between each of the terminal elements and one of the plurality of contact elements;

the connection module comprises a housing into which the terminal module is insertable, and a strain relief which is connected to the housing and engages over the terminal module;

a cable connected to the terminal module is adapted to be fixed to the connection module by means of the strain relief, the strain relief has a cable support element connected in a rigid manner to the housing and a cable clamping element connected in an articulated manner to the housing, said cable clamping element being adapted to be secured in at least one clamping position, and a lid is mounted for pivotal movement on the housing, said lid being movable back and forth between a closed position and an open position and adapted to be releasably secured in the closed position.

2. Electrical plug connector in accordance with claim 1, wherein the lid is adapted to be detachably connected to the cable support element.

3. Electrical plug connector in accordance with claim 1, wherein the cable clamping element is held for pivotal movement on the lid.

4. Electrical plug connector in accordance with claim 1, wherein the cable clamping element is adapted to be snapped together with the lid.

5. Electrical plug connector in accordance with claim 1, wherein the terminal module has a plurality of chambers, each receiving a pair of the conductors.

6. Electrical plug connector comprising:

a connection module having a plurality of contact elements for establishing an electrical connection to corresponding contact elements of a socket connector;

a terminal module having a plurality of terminal elements, each for connecting a conductor of a cable;

wherein:

the terminal module is adapted to be detachably connected to the connection module to establish an electrical connection between each of the terminal elements and one of the plurality of contact elements;

the connection module comprises a housing into which the terminal module is insertable, and a strain relief which is connected to the housing and engages over the terminal module;

a cable connected to the terminal module is adapted to be fixed to the connection module by means of the strain relief, and the housing is electrically conductive and a shield-contacting element which is electrically connected to the housing is adapted to be pressed against a shielding of the cable by the strain relief.

7. Electrical plug connector in accordance with claim 6, wherein the strain relief is adapted to be detachably connected to the cable and, once the connection between the strain relief and the cable is detached, the terminal module is removable from the housing of the connection module.

8. Electrical plug connector in accordance with claim 6, wherein the strain relief has a cable support element connected in a rigid manner to the housing and a cable clamping element connected in an articulated manner to the housing, said cable clamping element being adapted to be secured in at least one clamping position.

9. Electrical plug connector in accordance with claim 6, wherein the cable clamping element is adapted to be secured in a plurality of clamping positions.

10. Electrical plug connector in accordance with claim 6, wherein a lid is mounted for pivotal movement on the housing, said lid being movable back and forth between a closed position and an open position and adapted to be releasably secured in the closed position.

11. Electrical plug connector in accordance with claim 6, wherein:

the shield-contacting element is arranged on an inside of a cable clamping element, and the cable clamping element is connected in an articulated manner to the housing and adapted to be secured in at least one clamping position.

12. Electrical plug connector in accordance with claim 6, wherein the terminal module has a plurality of chambers, each receiving a pair of the conductors.

13. Electrical plug connector comprising:

a connection module having a plurality of contact elements for establishing an electrical connection to corresponding contact elements of a socket connector;

a terminal module having a plurality of terminal elements, each for connecting a conductor of a cable;

wherein:

the terminal module is adapted to be detachably connected to the connection module to establish an electrical connection between each of the terminal elements and one of the plurality of contact elements;

the connection module comprises a housing into which the terminal module is insertable, and a strain relief which is connected to the housing and engages over the terminal module;

a cable connected to the terminal module is adapted to be fixed to the connection module by means of the strain relief, and the terminal module has a circuit board on which the terminal elements are held, the circuit board having contact members which are each electrically connected to one of the terminal elements and adapted to be contacted by one of the plurality of contact elements.

14. Electrical plug connector in accordance with claim 13, wherein the terminal elements are held on both a top side and a bottom side of the circuit board.

15. Electrical plug connector in accordance with claim 13, wherein the terminal elements are press-fit into the circuit board.

16. Electrical plug connector in accordance with claim 13, wherein the terminal elements are configured as piercing contacts.

17. Electrical plug connector in accordance with claim 13, wherein the contact members are configured in the form of contact pads and the contact elements each comprise a contact spring which is adapted to be placed in contact with one of the contact pads, thereby undergoing elastic deformation.

18. Electrical plug connector in accordance with claim 13, wherein the terminal module has at least one terminal block with openings, each opening adapted to have one of the conductors of the cable inserted therein and aligned with one of the terminal elements, the at least one terminal block being held on the circuit board for movement between an assembly position and a contact position, the terminal elements in the assembly position of the at least one terminal block exposing the openings for insertion of the conductors, and the terminal elements in the contact position of the at least one terminal block extending into the openings to establish an electrical connection between each of the conductors and the terminal elements respectively.

19. Electrical plug connector in accordance with claim 18, wherein the terminal module has two terminal blocks between which is arranged the circuit board carrying the terminal elements on a top side and a bottom side.

20. Electrical plug connector in accordance with claim 19, wherein the circuit board has arranged thereon a guiding part protruding over the top side and the bottom side of the circuit board, the two terminal blocks being held for displacement on said guiding part, the guiding part extending into centrally arranged recesses of the terminal blocks.

21. Electrical plug connector in accordance with claim 20, wherein the guiding part forms a partition wall protruding perpendicularly between two pairs of the terminal elements from the circuit board.

22. Electrical plug connector in accordance with claim 21, wherein the partition wall forms an electrical shielding which is arranged between the two pairs of the terminal elements.

23. Electrical plug connector in accordance with claim 18, wherein:

the at least one terminal block in the assembly position is adapted to be fixed to a guiding part, and the guiding part protrudes over a top side and a bottom side of the circuit board, the at least one terminal block being held for displacement on the guiding part, the guiding part extending into centrally arranged recesses of the at least one terminal block.

24. Electrical plug connector in accordance with claim 18, wherein the housing forms a compartment having a compartment front section relative to a direction of insertion of the terminal module, said compartment front section receiving a circuit board front area of the circuit board where the contact members are arranged, and a compartment rear section receiving a circuit board rear area where the terminal elements and the at least one terminal block are held.

* * * * *